United States Patent [19]

Villa

[11] 4,192,001

[45] Mar. 4, 1980

[54] DECOMPRESSION ASCENT COMPUTER

[76] Inventor: Francesco Villa, 307 College Ave., Palo Alto, Calif. 94306

[21] Appl. No.: 856,819

[22] Filed: Dec. 2, 1977

[51] Int. Cl.[2] ..... G06F 15/42; G06G 7/60

[52] U.S. Cl. ..... 364/418; 73/432 R; 128/905; 128/204.23; 128/205.23

[58] Field of Search ..... 364/418, 558; 73/432 R; 128/2.1 R, 204

[56] References Cited

U.S. PATENT DOCUMENTS

| | | | |
|---|---|---|---|
| 3,457,393 | 7/1969 | Stubbs et al. | 364/418 |
| 3,681,585 | 8/1972 | Todd | 364/418 |
| 3,992,948 | 11/1976 | D'Antonio et al. | 364/418 X |
| 4,005,282 | 1/1977 | Jennings | 364/418 |
| 4,054,783 | 10/1977 | Seireg et al. | 364/418 |

*Primary Examiner*—Jerry Smith

*Attorney, Agent, or Firm*—Townsend and Townsend

[57] ABSTRACT

A portable computer for underwater use to provide a diver with indicia alerting him of the need for decompression pauses during ascent and to further provide a decompression ascent schedule. A pressure transducer measures the diver's depth during the dive and continuously transfers this information to simulators which simulate absorption or desorption by body tissues of nitrogen in response to the instantaneous hydrostatic pressure. The values generated by the simulators are normalized so that the maximum value beyond which decompression is required for each tissue is the same. The largest normalized value is selected for display to the diver from which he determines whether the need for decompression pauses will be required during ascent. When decompression pauses are indicated, the present hydrostatic pressure to which the diver is exposed and the largest normalized tissue absorption value are arithmetically combined. From this arithmetic combination there is generated a value from which the diver may determine an appropriate ascent schedule comprising time durations for decompression pauses at depths selected by the diver during ascent. In the preferred embodiment, the decompression ascent computer comprises analog circuitry to perform the simulating function. Additional analog circuitry performs the normalizing, selecting, and combining functions. An alternate embodiment utilizes digital techniques to perform the functions required to generate the indicia provided the diver indicative of the need of a decompression ascent schedule as well as the schedule itself.

23 Claims, 4 Drawing Figures

DECOMPRESSION ASCENT COMPUTER

BACKGROUND OF THE INVENTION

Below certain depths, underwater divers using a compressed breathing gas, are limited, not by their equipment but by the changes which take place in their body chemistry while breathing gas (air) under high pressure. Inert gases, such as nitrogen, enter the tissues of the body at higher rates and reach higher concentrations when breathed under pressure, the solubility going up with increased partial pressure. Prolonged and/or deep dives result in such higher concentrations in the body tissues that the diver must, during ascent to the surface, allow his body to desaturate from its excess nitrogen content. This is commonly referred to as decompression. Too rapid a return to the surface would allow the excess nitrogen, which is in a supersaturated state in the body tissues, to pass beyond the "bubble point." Small bubbles of gas would form in the body tissues, causing the "bends" or Casson disease, one of the worst maladies of diving.

The principal method now employed to guide the diver, during ascent, to insure safe release of excess nitrogen accumulated by his body tissues, is the use of dive tables which specify schedules of decompression pauses during ascents. Such tables are available from the U.S. Navy Experiment Diving Unit, Washington, D.C. and may be found in the "U.S. Diving Manual", NAVSHIPS, 250, 385. These tables are empirically derived and allow the diver a 95% safety factor. That is, if the diver precisely follows the properly selected table, he is 95% sure that the excess nitrogen accumulated by his body tissue will be released with no ill effect.

Derivation of these tables assumes the duration of the dive, from the time the diver entered the water to the time ascent begins, is spent at the maximum depth attained during the dive. Each table, therefore, is a decompression ascent schedule which corresponds to a specified maximum depth, to which a diver has descended and a specific dive duration. In use, a diver must carefully pre-plan his dive. He must select a maximum depth, below which he will not descend, and the specific duration of his dive. These parameters, once determined, allow the diver to select the table providing the appropriate decompression ascent schedule to be followed during ascent. However, since there is a finite number of decompression tables provided, there is a corresponding finite number of maximum depth and dive duration combinations a diver may select. As can be seen, such advance planning substantially limits the diver's ability to alter his dive, once the dive has commenced. Should the diver wish to dive deeper than originally planned or remain submerged longer than planned, he must consult the dive tables once again to determine a new decompression ascent schedule. Such a procedure is obviously impractical.

Repetitive dive situations, that is, where a subsequent dive is to be made soon after (within 24 hours) a prior dive, greatly magnify these problems. Selection of a table containing appropriate decompression ascent information must be made based upon the maximum depth attained, duration of the prior dive, and period of time between completion of the prior dive and initiation of the prospective subsequent dive—in addition to maximum depth and dive duration of the planned succeeding dive. Moreover, table selection for a subsequent dive, in repetitive dive situations, is made regardless of the amount of time elapsed between two succeeding dives—so long as they are made the same day. Thus, even if an extremely large number of tables are provided, the diver is still limited in planning repetitive dives.

Moreover, use of decompression ascent schedules fails to allow a diver to vary the risk factor of his ascent, should he so desire. As pointed out above, the risk factor provided by the U.S. Navy tables is 95%. A diver has no way of determining how to vary any particular decompression ascent schedule so that, if he wishes, he may exceed the 95% safety factor in order to shorten the time required to reach the surface.

SUMMARY OF THE INVENTION

Through an in-depth study of the above-mentioned U.S. Navy Decompression Tables, some pertinent and surprising properties were discovered. First, appropriate constants were found to scale or "normalize" the values representative of absolute partial pressure of nitrogen in various body tissues. This results in one value for all such normalized partial pressures indicative of nitrogen accumulation requiring decompression when reached or exceeded. Second, it was discovered that a linear relationship existed between this "normalized" value and the present measured hydrostatic pressure imposed upon the diver. In view of these newfound properties, and according to the present invention, there is provided a portable underwater computer that generates, from the measured hydrostatic pressure, normalized nitrogen partial pressures that are selectively displayed to the diver from which he may determine whether decompression pauses are required during ascent. If decompression is required, the computer also generates values which, when displayed to the diver, provide him with indicia from which he may plan a decompression ascent schedule according to his own needs.

Simulators, responsive to the measured hydrostatic pressures, are used to simulate nitrogen absorption or desorption by body tissues. Amplifiers receive the values generated by the simulators and scale or normalize the simulated values. Analog selection circuitry then selects the largest, in magnitude, of these normalized values for display to the diver. Additionally, analog calculating circuitry is provided to arithmetically combine the largest of the normalized simulated values with the measured hydrostatic pressure. The quantity generated by this arithmetic combination is the indicia a diver uses to plan a decompression ascent schedule when selected for display.

A preferred embodiment of the invention described herein utilizes a resistor-capacitor integrator network to integrate a voltage received from a pressure transducer that is proportional to the measured depth to simulate individual body tissues. These integrated values are applied to amplifier circuitry for scaling and then to analog selection circuitry that automatically selects the most positive scaled voltage value for display to the diver. This positive scaled voltage value and a second value proportional to the measured hydrostatic pressure, are applied to an operational amplifier which arithmetically combines the two values to generate therefrom indicia from which a decompression ascent schedule may be planned.

An alternate embodiment of this invention utilizes digital computer techniques in conjunction with microcomputer circuitry to perform the functions outlined with respect to the preferred embodiment. The microcomputer circuitry comprises memory systems for sorting specified constants, an analog-to-digital converter to convert depth information from the pressure transducer to digital form, and a central processing unit for performing the required numerical computation to generate the indicia from which a diver may determine whether decompression pauses are required and, if so, a decompression schedule. The central processing unit of the microcomputer receives predetermined constants stored in the memory systems and the measured hydrostatic pressure data to numerically integrate the measured hydrostatic pressure thereby generating a value representative of absorption or desorption of nitrogen by body tissue. The generated values are stored for later updating, scaling, and display to the diver. Additionally, the integrated values so scaled are arithmetically combined with a value proportional to the hydrostatic pressure, as above, to generate indicia from which a diver may plan a decompression ascent schedule.

In both embodiments, it should be noted that the values displayed to the diver are directly representative of the degree of nitrogen accumulation in his body tissues. Thus, a diver, during a dive, need not adhere to any specific schedule. Rather, he may dive to whatever depth is desired and, before ascending glance at his computing apparatus to determine whether decompression pauses will be required. Moreover, if such decompression pauses are required, he may then select the indicia from which an ascent schedule may be derived. As can be seen, there is no need to pre-plan a dive, as is required when using tables. Moreover, the ascent schedule for decompression is planned in accordance with the needs of the diver rather than the particular maximum depth to which the diver had descended. Thus, the time it takes to reach the surface can be kept at a minimum.

Further, the indicia provided the diver from which he plans his ascent schedule will also allow him to decrease the safety factor of the ascent if he so wishes. Thus, he may again decrease the time required to reach the surface.

An additional advantage of use of the invention described herein is obtained in the repetitive dive situation. When the diver reaches the surface after one dive he may keep the computing apparatus in operation while he is above the surface. At any time thereafter, he may initiate second or succeeding dives with the computing apparatus constantly generating indicia of absorption and desorption of nitrogen in the body tissue.

Thus, the requirement of carefully tailoring dives to stay within the parameters used to select decompression ascent tables for a first and subsequent dives, or having a number of tables close at hand in the event an unforeseen deviation from a planned dive is desired, is obviated.

BRIEF DESCRIPTION OF THE DRAWINGS

The invention will now be described, by way of non-limited examples, with reference to the accompanying drawings, in which.

DESCRIPTION OF THE INVENTION

The Navy tables, mentioned above, were empirically derived. However, they are based upon known relationships that describe the absorption or desorption of inert gases by living tissue in response to applied pressures. Several publications have described a simple mathematical model of the physiological absorption of nitrogen by the human body. See for example, "Computation of Decompression Schedules for Repetitive Saturation Excursion Dives" by H. R. Schreiner, et al., "Aerospace Medicine", Volume I, page 305, May, 1970. Thus, the absorption of gaseous nitrogen by a living tissue may be described by the simple differential equation:

$$\frac{dp}{dt} = k[P - p] \tag{1}$$

WHERE:

k is the inverse of the time constant for the particular body tissue;

P is the inspired partial pressure of nitrogen (proportional to depth);

p is the partial pressure of nitrogen in that particular tissue (a function of time); and t is time.

Using equation (1) as a guideline, the above-mentioned U.S. Navy tables were studied in depth. The results of this study revealed the following pertinent properties:

(i) "Normalizing" the absolute partial pressure in each tissue by multiplying it by an appropriate constant, $\gamma$, which was found to be a function of the time constant of each particular tissue, gave rise to a value which would indicate the point of nitrogen absorption for all body tissues, beyond which decompression pauses would be required. This value, $[\gamma p]_{max}$, is called the maximum allowable normalized partial pressure.

(ii) There is a linear relationship between the maximum allowable normalized partial pressure that can be tolerated by each body tissue and the value of P, the ambient hydrostatic pressure to which the diver is subjected. This relationship may be expressed as:

$$[\gamma p]_{max} = A + \alpha P. \tag{2}$$

WHERE:

A and $\alpha$ are constants and depend primarily upon the units used to measure the hydrostatic pressure, P.

The properties disclosed in (i) and (ii) are true for normal breathing mixtures having a nitrogen content of approximately 80%. It is believed that these properties remain true for other breathing mixtures. For example, while decompression schedules for helium-oxygen mixtures are still in a somewhat developmental stage, the little data available from the U.S. Navy concerning helium-oxygen breathing mixtures have been found to conform to the two properties herein disclosed.

Figure 1:
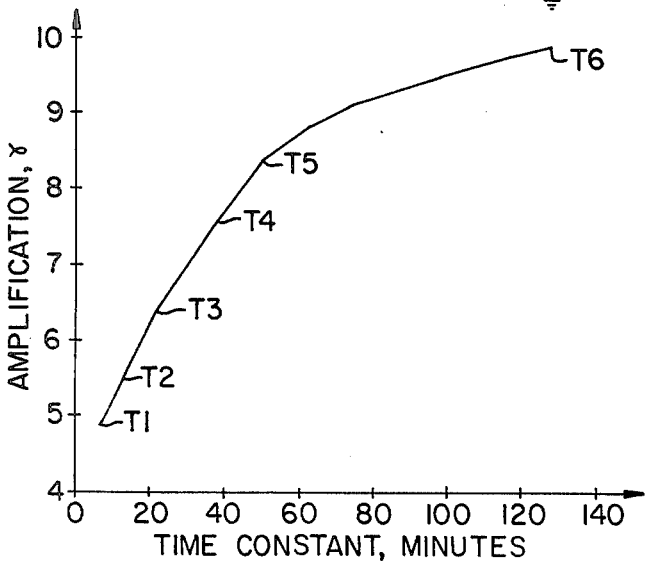
FIG. 1 is a graphic illustration of the relationship between the normalizing factors and corresponding time constants of the body tissues.

Referring to FIG. 1, there is depicted a graphic illustration of the relationship between the time constant and appropriate normalization or scaling factor for different body tissues. For example, a body tissue having a nitrogen (absorption or desorption) time constant of 20 minutes, would require an amplification factor of approximately 6.2 to "normalize" the absolute partial pressure of nitrogen for that tissue. Similarly, a tissue having the time constant of 40 minutes would require an approximate amplification factor of 7.8 for normalization. Multiplying the absolute partial pressures of nitrogen in each body tissue by the amplification factor corresponding to the particular time constants of each body tissue will obtain the quantity, $\gamma p$, referred to above. Moreover, although the absorption or desorption rate for each tissue may be different, determined by their respective time constants, the particular normalized maximum value indicative of the point of nitrogen accumulation in any particular tissue beyond which decompression is required will be the same for both tissues. This value, $[\gamma p]_{max}$, is, as mentioned above, referred to as the maximum absolute partial pressure.

Figure 2:
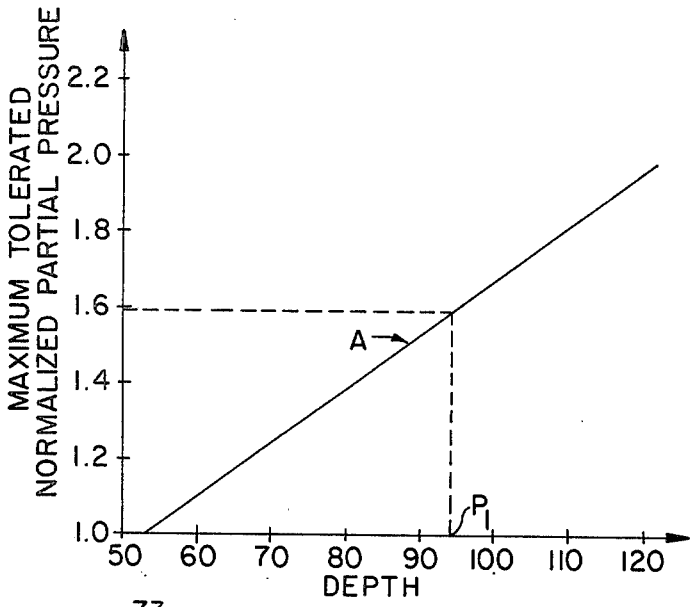
FIG. 2 is a graphic illustration of the linear relationship between the maximum allowable normalized partial pressure for all body tissues, and the hydrostatic pressure to which the diver is subjected.

Referring now to FIG. 2, there is graphically illustrated the relationship between the maximum tolerated partial pressure values obtained and the hydrostatic depth of the diver. As can be seen, this relationship, expressed in general form by equation (2), above, is linear. Therefore, since the maximum amount of nitrogen that can be accumulated by any body tissue, when normalized, is the same, the line A of FIG. 2 represents a maximum partial pressure accumulation of nitrogen of the body as a whole. Thus, the values of maximum normalized partial pressures that are above the line for any particular depth indicate that decompression will be required to safely release that nitrogen. Alternately, values below the line A indicate that the maximum tolerated partial pressure of nitrogen has not yet been reached and, therefore, no decompression is required.

FIGS. 1 and 2 were derived by a reiterative process using the values from the Navy Tables (cited above) and the knowledge that under steady state conditions (e.g., depth not a function of time) the partial pressure of an inert gas accumulated by any one particular body tissue can be described by an equation of the form:

$$p(t)=1-e^{-kt} \quad (3)$$

Equation (3) is essentially the steady state solution of equation (1) wherein:

p(t) is the partial pressure of nitrogen in a body tissue at any particular momemt in time, t; and k is the inverse of the time constant for each body tissue.

Values from the U.S. Navy Diving Tables were used to calculate various partial pressures which were then normalized. Conventional Chi-Square minimizing fit procedures were then utilized to search for functional relationships between the normalized values so calculated and depth. Using the reiterative process of obtaining certain amplification constants for normalizing which, in turn, were used to calculate the maximum tolerated normalized partial pressure of nitrogen, the amplification factors for each time constant depicted in FIG. 1 were found and the linear relationship depicted in FIG. 2 discovered.

Figure 3:
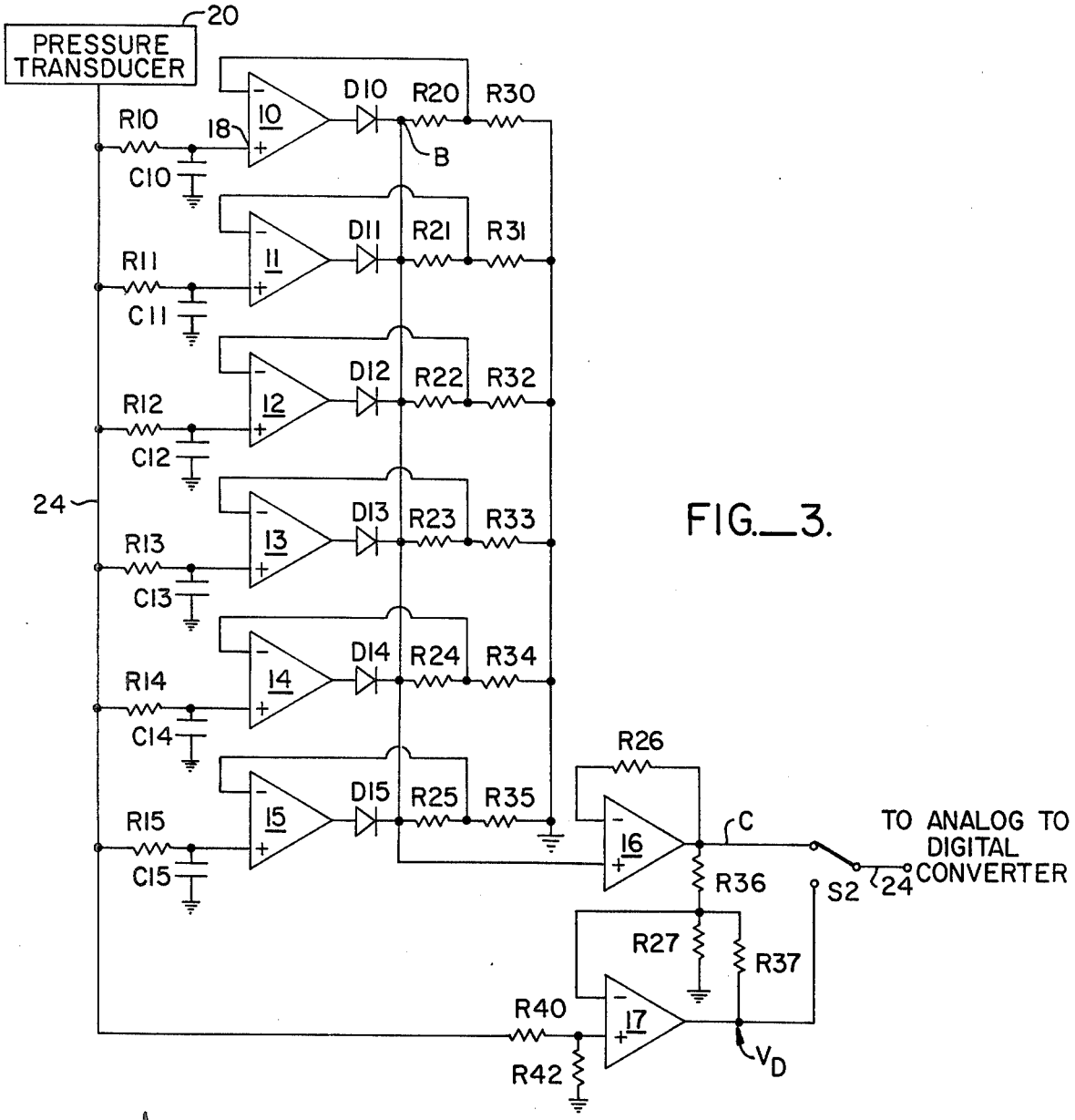
FIG. 3 is a diagrammatic representation of one embodiment of this invention using resistor-capacitor integrating networks to simulate body tissue.

Referring now to FIG. 3, there is shown one embodiment of this invention which utilizes the relationships of FIGS. 1 and 2. A pressure transducer 20 is shown, which measures the hydrostatic pressures to which the diver is subjected and converts that pressure to an electrical voltage. The voltage output of pressure transducer 20 is communicated to the six resistor-capacitor combinations R10–C10, R11–C11, R12–C12, R13–C13, R14–C14, and R15–C15, which simulate the partial pressure accumulated by six different body tissues. Operational amplifiers 10, 11, 12, 13, 14 and 15 amplify values derived by resistor-capacitor combinations R10–C10 through R15–C15 to provide the amplification factors that normalize each simulated partial pressure value. The largest value of the normalized partial pressure is selected by the analog "OR" network comprising diodes D10–D15. The output of diodes D10–D15 is applied to a conventional analog to digital converter (not shown) via operational amplifier 16 and switch S2 for display to the diver. Switch S2 is used to select the output of operational amplifier 17. Operational amplifier 17 arithmetically computes the difference between the maximum normalized partial pressure and a value proportional to the hydrostatic depth of the diver.

Pressure transducer 20 is typically an LX 1620 AF, commercially manufactured by National Semiconductor Corporation. The voltage output of pressure transducer 20 is appropriately scaled by a resistive voltage divider network (not shown) so that applied to line 24, is a voltage proportional to the inspired partial pressure of nitrogen (or any other inert gas) in the breathing mixture of the diver.

The resistor-capacitor networks R10–C10 through R15–C15 simulate nitrogen partial pressure absorption or discharge by body tissues in response to inspired hydrostatic pressures by integrating the voltage from pressure transducer 20. The time constants of each resistor-capacitor network R10–C10 through R15–C15 are obtained directly from FIG. 1 and are selected to conform to the appropriate amplification factor for each respective time constant.

At this point, it is appropriate to mention that the preferred number of body tissues simulated for an excellent approximation of all body tissues is six. However, any other number of tissues may be selected if one requires more or less accuracy. It has been found that for deep dives tissue constants less than (60) minutes are the critical parameters. Shallow dives for long periods of time require consideration of those tissues having long-time constants. Therefore, an excellent approximation of the nitrogen partial pressure absorption or discharge by all body tissues are adequately represented by those time constants spaced approximately around the values indicated on FIG. 1 by the points T1 through T6. Thus, time constants of 7, 14, 24, 39, 50 and 126 minutes were selected to adequately simulate the concentration of nitrogen and change of nitrogen by the body tissue of a diver.

Capacitors C10 through C15 should be a type having very low leakage current so that error, caused by voltage drift of the capacitor, is minimized. Capacitors commercially manufactured by Gould, Inc. were used in this embodiment.

Operational amplifiers 10 through 15 provide an amplification described by the equation:

$$A1i=1+R2i/R3i \quad (5)$$

where "i" has values from 0 to 5. The values of resistors R20 through R25 and R30 through R35 are appropriately selected to obtain the necessary amplification factor corresponding to the selected time constants. Referring to FIG. 1, for the selected time constants mentioned above, amplification factors of 4.9, 5.6, 6.6, 7.6, 8.3 and 9.9, respectively, were selected.

Each of the outputs of amplifiers 10–15 are coupled to point B by diodes D10–D15, respectively. Diodes D10–D15 act to select the most positive amplifier output. For example, assume the output of amplifier 10 to be a positive two volts while the outputs of amplifiers 11–15 do not exceed one volt. Diode D10 will be forward biased so that point B will be approximately two volts. This will cause the cathodes of diodes D11–D15 to be more positive than their anodes by approximately one volt. Thus, diodes D11–D15 are reversed biased, effectively blocking from point B the voltage outputs of amplifiers 11–15. The most positive output voltage from amplifiers 10–15 has been selected to appear at point B.

Amplifier 16 buffers the voltage appearing at point B. The output of amplifier 16 is coupled by switch S2, to a conventional analog to digital converter (not shown) connected to line 24. The analog to digital converter converts the voltage to digital information that is displayed to the diver by conventional small scale numeric read-out devices (not shown) such as Light Emitting Diode (LED) displays or the like.

Amplifier 17 receives the output of amplifier 16 and the output of the pressure transducer 20 and arithmetically computes the difference between these two quantities. The value representing this difference outputted by amplifier 17, may be selected by the diver by switch S2. The value generated by amplifier 17 is therefore coupled through switch S2, to the analog to digital converter and LED display.

Having described the elements and their interconnections that make up the preferred embodiment of this invention, shown in FIG. 3, the operation of the invention may now be described. Initially, before a dive is initiated, capacitors C10 through C15 must be charged to a value representative of the absolute partial pressure of nitrogen in body tissue under atmospheric conditions. Thus, the ascent computer should be powered sometime prior to making the dive or, alternatively, set to the appropriate value via a low impedance path (not shown).

During the dive, pressure transducer 20 continually measures the hydrostatic pressure to which the diver is subjected. Pressure transducer 20 converts this pressure to a voltage proportional to the inspired partial pressure of nitrogen. The voltage output by pressure transducer 20 is applied to the resistor-capacitor combinations R10–C10 through R15–C15 which integrate this voltage at a rate determined by the time constant of each combination. Thus, appearing at input 18 of amplifier 10, for example, will be, in effect, the solution of equation (1), above; that is, input 18 presents to amplifier 10 the absolute partial pressure of nitrogen in the body tissue having the time constant inherent in R10–C10.

The integrated voltage from the resistor-capacitor combinations R10–C10 through R15–C15 are normalized by amplifiers 10–15 and the largest voltage outputted by the amplifiers selected by the analog logic circuit, consisting of diodes D10–D15, as explained above. Thus, appearing at point B is the maximum normalized partial pressure of nitrogen for one of the six selected body tissues. The voltage at point B is buffered, by amplifier 16 and applied to the analog to digital converter (not shown) for display to the diver via a numeric display (not shown). If the voltage at point B exceeds the voltage representative of $[\gamma p]_{max}$, the maximum allowable partial pressure of nitrogen for body tissue, the diver is alerted to the fact that decompression pauses will be required during ascent.

In the preferred embodiment of FIG. 3, pressure transducer 20 provides a pressure (depth) to voltage conversion of 66 millivolts/atmosphere. As used herein, the term atmosphere denotes appropriate scaling resistors (not shown) so that line 24 is presented with a voltage representative of the partial pressure of whatever inert gas in the breathing mixture is desired. In the case of nitrogen, the voltage appearing upon line 24 will be 80% of the original voltage produced by pressure transducer 20 (e.g., 66 millivolts/atmosphere) or 52.8 millivolts/atmosphere.

Resistors R26, R27, and R36 are selected so that the output of amplifier 16, point C, will have a voltage of one volt thereon to indicate the quantity $[\gamma p]_{max}$. Thus, a voltage at point C less than one volt will indicate to the diver that the maximum allowable normalized partial pressure for the particular depth at which he is presently at has not been reached or exceeded. Alternatively, of course, a voltage at point C equaling or exceeding one volt, indicates to the diver that decompression pauses during ascent will be required.

If $[\gamma p]_{max}$ is exceeded during the dive and the diver wishes to begin ascent, he switches S2 to select amplifier 17 for display. As mentioned, amplifier 17 receives the voltage generated by amplifier 16 which is the normalized partial pressure of nitrogen in a selected body tissue. Amplifier 17 also receives the voltage provided by pressure transducer 20, scaled by resistors R40 and R42. Amplifier 17 then combines these received voltages to generate a value indication of the deviation from line A of FIG. 2.

The output $V_D$ of amplifier may be mathematically expressed as:

$$V_D = MP - \gamma p + N \tag{6}$$

WHERE:

$V_D$ is the output of amplifier 17 in millivolts;

M and N are preselected constants;

P is the hydrostatic pressure; and $\gamma p$ is the normalized nitrogen partial pressure of a body tissue.

The constants M and N are appropriately selected so that equation (6) not only conforms to the relationship depicted in FIG. 2, but the diver is provided with convenient values from which he may derive a decompression ascent schedule. Resistors R40 and R42 appropriately scale the voltage provided by pressure transducer 20 while resistors R27, R37, and R36 scale the voltage representing $\gamma p$ such that voltage $V_D$ appearing at the output of amplifier 17 will be 100 millivolts to indicate any point on line A of FIG. 2. For example, a depth represented by the hydrostatic pressure $P_1$ (FIG. 2) will cause the voltage output of amplifier 17, the voltage at $V_D$, to be 100 millivolts if the normalized partial pressure of nitrogen in any represented body tissue, $\gamma p$, equals the maximum allowable normalized partial pressure, $[\gamma p]_{max}$.

As can be seen from equation (6) an increase in the normalized partial pressure, $\gamma p$, while the hydrostatic pressure, P, remains constant will be reflected by a decrease in the voltage of $V_D$. Thus, if the voltage drops to, or below, the 100 millivolts, indicating that $[\gamma p]_{max}$ has been reached or exceeded, a decompression pause is indicated before ascending. The time the diver must spend at each depth during each pause is calculated by the computing apparatus for the diver. For, while the diver pauses at any particular depth, capacitors C10 through C15 will discharge in a manner and at a rate directly representative of release of nitrogen from body tissue. The diver need make no calculations, but merely waits until the reading provided him indicates the voltage at $V_D$ has reached or exceeded 100 millivolts; this, in turn, indicates that the partial pressure of nitrogen in his body tissue at least does not exceed that amount requiring decompression for that depth.

Therefore, when a diver begins his ascent, if decompression is indicated, he may ascend to a depth safe for him, before pausing to allow the excess nitrogen to be released from the body tissues. He monitors the display of the ascent computer apparatus such that when $V_D$ is 100 millivolts or greater, he knows he may again start his ascent.

Since equation (2) [and also, therefore, equation (6)] is derived, effectively, from the Navy tables, an ascent which closely follows the 100 millivolt output of amplifier 17 will also follow a Navy table for the particular depth from which a diver is ascending. In such case, the ascent will have approximately the 95% safety factor provided by the tables. However, the indicia provided the diver, in the form of the voltage $V_D$, allows him to adjust the safety factor of a decompression ascent to his own needs and desires. Thus, a diver preferring a lower safety factor need not adhere to the 100 millivolt output of amplifier 17. For example, a diver, during decompression ascent, may select 90 millivolts as the standard. He may ascend to a depth which causes the voltage $V_D$ to become less than 90 millivolts. He would then stop his ascent at this depth, monitor the indicia provided by the computing apparatus (e.g., essentially the voltage at $V_D$), and again commence ascending when the voltage at $V_D$ reaches or exceeds 90 millivolts.

Alternately, the diver may select a $V_D$ voltage reading greater than the 100 millivolt standard. This, in turn, will provide the diver with a safety factor greater than the 95% safety factor provided by the Navy decompression tables.

DIGITAL MICROPROCESSOR USING NUMERICAL INTEGRATION

Referring again to equation (1), an approximate solution for the partial pressure of nitrogen, p, for an arbitrary inspired partial pressure of nitrogen, P, can be found using numerical integration techniques in conjunction with microcomputer circuitry. There are several methods by which the partial pressure of nitrogen, p, may be approximated.

For example, equation (1) may be rewritten, using finite differentials, as:

$$\frac{\Delta p}{\Delta t} k (P - p_o) \tag{7}$$

WHERE:

k and P are the same quantities as those contained in eq. (1); and $p_o$ is the nitrogen partial pressure of a particular body tissue at time $t_o$.

Using $p = p_1 - p_o$, simple algebraic manipulation of eq. (7) results in the following:

$$p_1 = p_o + k \cdot \Delta t (P - p_o) \tag{8}$$

WHERE:

$p_1$ is the nitrogen partial pressure of the body tissue at time $(t_o + \Delta t)$.

The approximation to the general solution for the nitrogen partial pressure $p_1$ of equation (8) is quite good if the time interval, $\Delta t$, between two successive updates of the same tissue is small. A more accurate approximation to the solution of equation (1) for the partial pressure of nitrogen, where $\Delta t$ is not required to be as small, can be found using the equation:

$$p_1 = p_o + (P - p_o)(1 - e^{-k\Delta t}) \tag{9}$$

It is to be noted that $k\Delta t$ is the first term of the series expansion for $(1 - e^{-k\Delta t})$. The two terms will be approximately equal if $\Delta t$ is sufficiently small.

It should also be noted that the approximations obtained by equations (8) and (9) are achieved only through the assumption that the inspired nitrogen partial pressure, P (which is proportional to depth), is assumed constant. However, if the time interval, $\Delta t$, between two successive updates of the same tissue is reasonably large, some error could be introduced by this assumption. Therefore, in order to achieve better accuracy, one can assume that P is a linear function of time, t, in the interval $\Delta t$. In this case, the updating assumes the form:

$$p_1 = p_o + e^{-kt} \int_b^t P(\alpha) e^{K\alpha} dk\alpha \tag{10}$$

WHERE:

$P(\partial)$ is the hydrostatic pressure; and $p_o$, k, and t are the same quantities used in prior equations.

Figure 4:
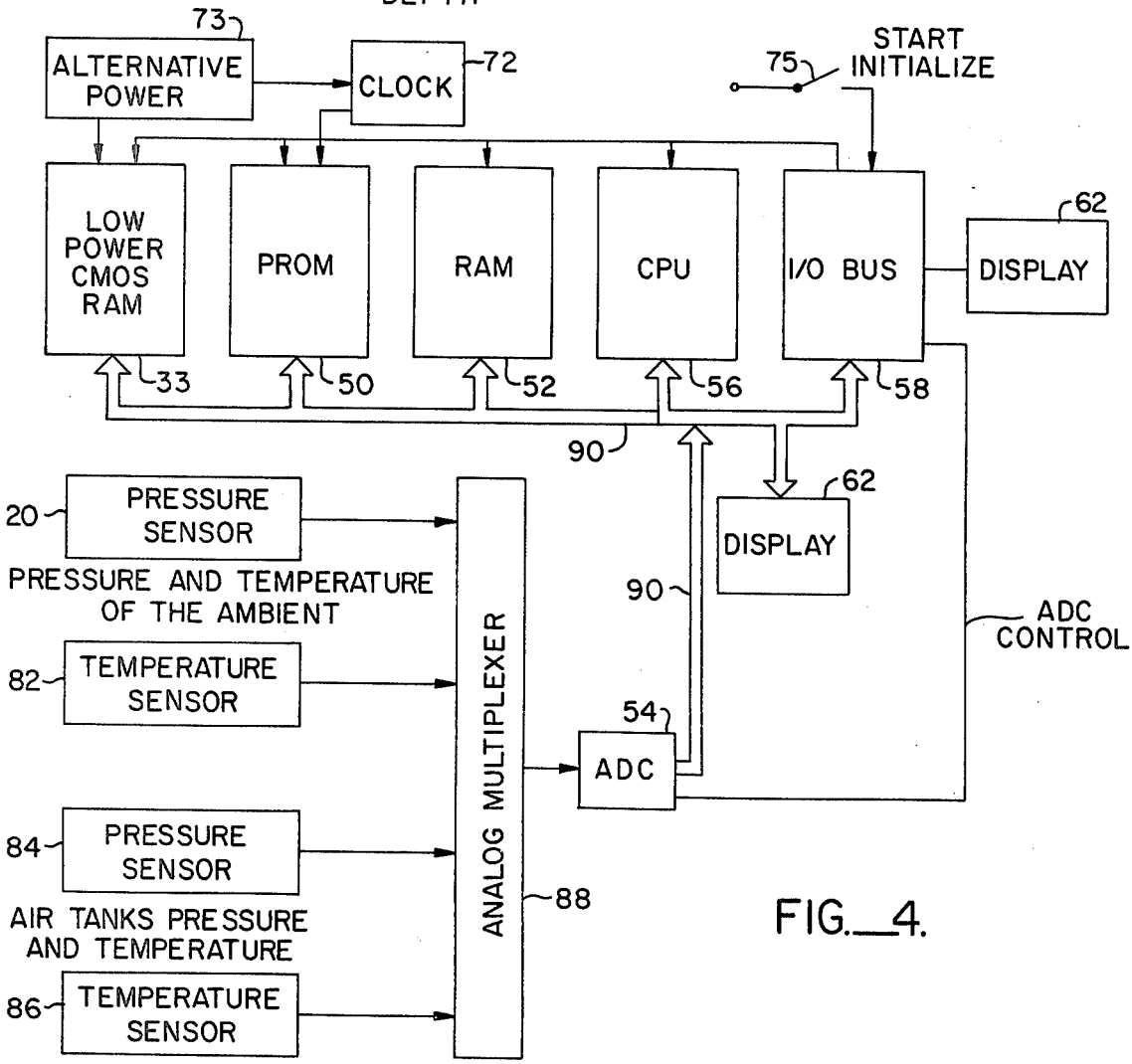
FIG. 4 illustrates, in block diagram, a further embodiment of this invention, utilizing a microprocessor to perform continual numerical integrations to generate a result indicative of a decompression ascent schedule.

The method of approximating a solution to equation (1) for the partial pressure of nitrogen, p, disclosed in equations (8)–(10), can easily be implemented using basic digital computer techniques. Referring to FIG. 4, there is shown a block diagram of a digital microprocessing unit capable of performing the calculations required by equations (8)–(10) to generate values approximating nitrogen accumulation by body tissues, to scale these values and select therefrom the one value representing maximum nitrogen accumulation, to perform the necessary calculations to determine if decompression is needed, and, if so, generate the indicia used for decompression ascent.

Referring specifically to FIG. 4, there is shown pressure transducer 20 that develops an analog voltage, proportional to hydrostatic pressure, which is applied to analog to digital converter (ADC) 54 via analog multiplexer 88. Analog to digital converter 54 transforms this analog voltage to a digital quantity that will be sampled by the Central Processing Unit (CPU) 56 at predetermined times during calculations.

Central Processing Unit (CPU) 56 is of conventional design and contains appropriate digital circuitry (not shown) for performing such arithmetic operations as addition, subtraction, and multiplication and includes a limited amount of storage to facilitate these operations. Additionally, CPU 56 contains an accumulator for accumulating and temporarily holding digital sums or totals during arithmetic operations.

Random Access Memory (RAM) 52 provides storage for the variable quantities calculated by the microprocessor of FIG. 4; such quantities as the present calculated nitrogen partial pressures of represented body tissues ($p_o$) and the normalized nitrogen partial pressure ($\gamma p_o$).

Programmable Read-Only Memory (PROM) 50 will provide storage for those values which may be predetermined. Thus, such values as the time constant for each body tissue (k), the normalization or scale factor for each body tissue ($\gamma$), and the appropriate time increments ($\Delta t$) are stored in PROM 50 some time prior to use of the microprocessor. Additionally, the instructions that form the basic programs are also stored in PROM 50. It should be noted that the time constants and time increment need not be separately stored. Since eq. (8) requires only the quantity $k.\Delta t$, PROM 50 preferably contains this predetermined quantity prior to use for calculating the simulated partial pressure of nitrogen in each representative body tissue of the diver. Alternately, if eq. (9) is the equation used, the term $e^{-k\Delta t}$ may be stored.

Access to CPU 56, for PROM 50, RAM 52, and analog to digital converter 54, is selective with such selection made by Input/Output (I/O) Bus 58 under the command and control of CPU 56. Digital data is transmitted to and from the elements of the computer via an 8-bit bi-directional data bus 90.

Taking eq. (8) as an example, the operation of the microprocessor can now be described in terms of the steps required to approximate nitrogen partial pressure accumulations by designated body tissues and using these approximations in generating the required indicia. Operation of the microprocessor is commenced by a start/initialize pulse generated by operation of pressbutton 75 just prior to initiation of a dive. Timing and control circuitry within CPU 56 commences to continuously provide the necessary timing and control pulses necessary to cause the microprocessor to perform the following operations [symbols are as in equation (8)];

(1) Read the hydrostatic pressure (P) into CPU 56 provided by pressure transducer 20 via analog multiplexer 88 and analog to digital converter 54;
(2) Read last nitrogen partial pressure calculations ($p_o$) from RAM 52 into CPU 56;
(3) Calculate ($P-p_o$) and hold in CPU 56;
(4) Read $k.\Delta t$ from PROM 50 into CPU 56;
(5) Multiply $(P-p_o)\cdot k\cdot\Delta t$ and hold in CPU 56;
(6) Read (again) $p_o$ from RAM 52 into CPU 56;
(7) Add $p_o+(P-p_o)\cdot k\cdot\Delta t$;
(8) Store $p_1$ [the quantity calculated in step (7)] in RAM 52 in the same location $p_o$ was stored ($P_1$ now becomes $P_o$ when the next partial pressure is calculated).

After $p_1$ has been calculated and stored in RAM 52 for the 6 (or any other number of) tissues, RAM 52 will now contain the updated nitrogen partial pressures representing the nitrogen partial pressure accumulation of the body tissues of the diver.

At this point, the microprocessor will sequentially scan through the various $p_1$ stored in RAM 52, multiplying each by the appropriate normalization constants stored in PROM 50. The largest value of this last-mentioned multiplication will be retained in RAM 52. This value is displayed either continuously or upon demand by display 62, which may be an LED number set. If the number so displayed exceeds a predetermined value (i.e., indicative of the no-decompression limit displayed in FIG. 2) the diver will know that he may ascend to a specified depth. At this time, he may request the microprocessor to calculate the particular depth to which he may ascend before a decompression stop is required. The microprocessor will then calculate the depth according to the linear relationship of equation (3).

The computing, storage and control portions of the microprocessor can be accommodated by micro-electronic circuitry produced by the Solid State Division of RCA. Thus, CPU 56 is implemented by the device, part no. CDP 1802, and CDP 1852, respectively, also commercially manufactured by the Solid State Division of RCA.

Utilizing the numerical integration approach in conjunction with microprocessing techniques to calculate a decompression schedule offers several advantages. First, with appropriate programming, the microprocessor can be used to predict important quantities before the dive begins. For example, the amount of air necessary for a dive at 160 feet for 32 minutes, given a standard consumption rate, will normally differ from diver to diver. The computer may be used to "simulate" the dive and calculate the air needed in a very short time (a matter of seconds).

Moreover, the number of tissues can be rather large, since the addition of a tissue requires no additional hardware and the accuracy of computation will be higher than any practical analog system.

Additionally, appropriate programming of the microprocessor of FIG. 4 will allow a diver to calculate the amount of air needed to return to the surface. That is, a calculation of the time at which the diver must begin the ascent in order to reach the surface before his air supply is depleted. Thus, a warning signal may be generated based upon the actual air consumption of the diver and the microprocessor's calculation of the decompression cycle, while computing the nitrogen partial pressure updates for each simulated tissue.

The actual air consumption can be measured continuously by monitoring the pressure drop of the air tanks at fixed intervals of time. Therefore, referring to FIG. 4, pressure sensor 84 is coupled to the air tanks (not shown) worn by the diver to develop a voltage proportional to the air pressure of the diver's air tanks. The voltage from pressure transducer 84 is coupled to analog to digital converter 54 via analog multiplexer 88 under the control of I/O Bus 58, to generate a digital value usable by CPU 56. After the simulated nitrogen partial pressures for each tissue (e.g., the individual $P_1$) have been calculated and stored in RAM 52 the microprocessor can then calculate the time required to reach the surface by varying the hydrostatic pressure, P.

Once the calculation of time required for each tissue is made these times are compared to find the maximum amount of time which, in turn, is compared to the value proportional to the air pressure in the air tanks. If the amount of air required to traverse the distance from the diver's present depth to the surface is within, for example, 80% of the available air, this value may be displayed upon demand. Further, if this 80% value is exceeded, an alarm can be used to warn the diver.

A still further advantage of using microprocessor A lies in the use of more convenient and less expensive sensors for the system. The shortcomings of the system may be compensated for by arithmetic computations. For example, the most convenient and inexpensive forms of pressure transducers are the piezoresistive sensors. However, piezoresistive sensors are temperature-sensitive. Thus, the microprocessor can be utilized to accommodate these convenient and inexpensive piezoresistive sensors by adding a temperature sensor 82 (FIG. 4) and compensated for temperature variations by calculating the true value of the pressure. Such a calculation would follow the equation:

$$P\ \text{correct} = P\ \text{measured} + \alpha - \text{Temperature} \quad (11)$$

The eight illustrative steps used to calculate an updated approximation of nitrogen partial pressure accumulation in each body tissue would require modification only by replacing step (1) by the following steps:

(1) Read the hydrostatic pressure transducer 20 via analog multiplexer 88 and analog to digital converter 54 into CPU 56;

(2) Read temperature sensor 82 via analog multiplexer 88 and analog to digital converter 54 into CPU 56;

(3) Calculate actual hydrostatic pressure (P) according to equation (11) and retain in CPU 56.

The microprocessing embodiment of the invention described herein is particularly useful in a repetitive dive situation. As pointed out above, the partial pressure of nitrogen in the body tissues does not return to normal until some time after the diver reaches the surface of an initial dive. Thus, if the diver again dives, the above normal partial pressure of nitrogen in his body tissue must be taken into account. One method, of course, is to leave the microprocessor running to continually update approximations of the nitrogen content of a diver's body tissues. However, the microprocessor A is provided with a low-power complementary MOS (CMOS) RAM 33 which is utilized as an auxiliary memory storage unit. Thus, when the power is turned off, the last calculated (updated) values of nitrogen partial pressure, p, are stored in RAM 33. Also stored in RAM 33 is the clock time immediately preceding the time the microprocessor is turned off. Auxiliary power supply 73 is activated to supply a minimum amount of power to RAM 33, as well as clock 72.

When the microprocessor is again turned on, a computation is made using the clock time stored in RAM 33 to determine if the elapsed microprocessor off-time is greater than 24 hours. If so, the initial values of nitrogen partial pressures of normal atmospheric pressure values will be used. However, if the elapsed off-time is less than 24 hours, the nitrogen partial pressures of the simulated tissues, p, will be updated, thereby generating nitrogen partial pressure values closely approximating the actual nitrogen partial pressure of the body tissue of the diver which is above normal atmospheric pressure values.

It is understood that the above-described invention is merely illustrative and susceptible to considerable modification within the skill of the art. Accordingly, all such variations and modifications are included within the spirit and scope of the invention.

I claim:

1. A portable decompression ascent computer for underwater use by a diver using a breathing mixture containing an inert gas comprising:

simulating means for generating values representing inert gas partial pressure in at least two body tissues in response to a measured hydrostatic pressure;

scaling means responsive to said simulating means for generating normalized values of said values representing inert gas partial pressure; and arithmetic means responsive to said scaling means for combining the largest of said normalized values with a quantity proportional to the measured hydrostatic pressure and for generating therefrom indicia of whether a decompression ascent schedule will be required.

2. The portable decompression ascent computer of claim 1, and including:

transducer means for measuring the hydrostatic pressure.

3. The portable decompression ascent computer of claim 2, and wherein said simulating means includes:

integrating means responsive to said transducer means for integrating said measured hydrostatic pressure.

4. The portable decompression ascent computer of claim 3, and wherein said integrating means comprises:

at least one resistor with at least one capacitor.

5. The portable decompression ascent computer of claim 1, and wherein said arithmetic means includes:

computing means for generating second indicia defining a decompression ascent schedule.

6. The portable decompression ascent computer of claim 5, and including:

display means responsive to said arithmetic means for providing the diver with said second indicia defining a decompression ascent schedule.

7. A portable decompression computing apparatus for determining from the hydrostatic pressures to which a diver is subjected, the need for decompression during ascent and for computing a decompression ascent schedule, comprising:

measuring means for measuring the hydrostatic pressure;

simulating means responsive to said measuring means for generating values representative of absorption and desorption of inert gas by a plurality of body tissues in response to hydrostatic pressures;

scaling means for receiving and normalizing said values;

selection means responsive to said scaling means for selecting the largest in magnitude of said normalized values outputted by said scaling means; and arithmetic means responsive to said measuring means and said selection means for computing and generating therefrom indicia of decompression ascent schedule.

8. The portable decompression apparatus of claim 7, wherein said simulating means includes:

integrating means responsive to said measuring means for generating said representative absorption and desorption values.

9. The portable decompression ascent computer of claim 8, wherein said integrating means comprises:

at least one resistor and at least one capacitor for each body tissue.

10. The portable decompression ascent computer of claim 7, wherein said arithmetic means comprises a difference amplifier.

11. The portable decompression ascent computer of claim 7, wherein said scaling means comprises operational amplifiers for each body tissue simulated, each of said operational amplifiers outputting a voltage representative of said normalized values.

12. The portable decompression ascent computer of claim 11, wherein said selection means comprises:

a plurality of diodes each having at least one cathode and anode with the anodes of all said diodes jointly coupled together and the cathodes of all said diodes responsive to said operational amplifiers for selecting the voltage largest in magnitude outputted by said operational amplifiers.

13. The method of computing the need for decompression stops and a decompression ascent schedule, which comprises:

generating a value simulating the absorption and desorption of an inert gas for each of a plurality of body tissues in response to an applied pressure and duration of the applied pressure;

normalizing each of the simulated values to produce a normalized simulated value for each of the plurality of body tissues indicative of the requirement of decompression stops when the normalized simulated value at least equals a predetermined value; and comparing the largest normalized simulated value to a value proportional to the applied pressure to derive therefrom a decompression value indicative of the need for decompression and from which a decompression ascent schedule is determined.

14. The method of claim 13, including:

measuring continuously the hydrostatic pressure; and generating from said measured hydrostatic pressure a quantity that is utilized by said simulating step.

15. The method of claim 14, wherein said simulating step includes:

integrating said quantity.

16. The method of claim 13, including:

selecting a largest normalized simulated value from the normalized simulated values produced in said normalizing step for use in said comparing step.

17. A special purpose, portable decompression computer for underwater use to calculate, from a measured hydrostatic pressure, indicia from which a diver may determine the need for decompression pauses during ascent comprising:

transducer means for measuring the hydrostatic pressure and outputting therefrom a digital representation of said hydrostatic pressure;

memory means for storing digital data representative of a plurality of predetermined quantities for use in calculating representations of inert gas partial pressure in at least two body tissues in response to hydrostatic pressure, for storing said partial pressure representations when calculated, and for storing a plurality of digital scaling factors; and processor means responsive to said transducer means and said memory means for performing arithmetic operations to calculate said partial pressure representations, for using said scale factors to calculate a normalized quantity for each said partial pressure representation, and for selecting the largest normalized value for combination with the digital representation of the measured hydrostatic pressure to generate therefrom said indicia.

18. The special purpose, portable decompression computer of claim 17, including:

selecting means interposed between said transducer and memory means and said processing means for selectively coupling said transducer means and said memory means to said processing means.

19. The special purpose, portable decompression computer of claim 17, wherein said transducer means comprises:

measuring means for measuring the hydrostatic pressure and generating a voltage representative of the measured hydrostatic pressure.

20. The special purpose, portable decompression computer of claim 19, including:

converting means responsive to said voltage for converting said voltage to a digital quantity representative of said measured hydrostatic pressure.

21. The special purpose, portable decompression computer of claim 20, wherein said processor means includes:

arithmetic means for generating a second indicia of a decompression ascent schedule.

22. The special purpose, portable decompression computer of claim 21, wherein said memory means includes:

a read-only memory means for storing said predetermined quantities.

23. The special purpose, portable decompression computer of claim 17, including:

input-output control means for controlling and regulating the digital data flow between the transducer means, the memory means and the processor means.

* * * * *